US010186375B2

(12) United States Patent
Kwon

(10) Patent No.: US 10,186,375 B2
(45) Date of Patent: Jan. 22, 2019

(54) METHOD OF MANUFACTURING COIL UNIT IN THIN FILM TYPE FOR COMPACT ACTUATOR

(71) Applicant: EneBrain Co., Ltd., Gyeonggi-do (KR)

(72) Inventor: Joung Sek Kwon, Gyeonggi-do (KR)

(73) Assignee: EneBrain Co., Ltd., Gyeonggi-do (KR)

( * ) Notice: Subject to any disclaimer, the term of this patent is extended or adjusted under 35 U.S.C. 154(b) by 14 days.

(21) Appl. No.: 15/390,404

(22) Filed: Dec. 23, 2016

(65) Prior Publication Data

US 2018/0019058 A1 Jan. 18, 2018
US 2018/0182543 A9 Jun. 28, 2018

(30) Foreign Application Priority Data

Jul. 14, 2016 (KR) ..... 10-2016-0089007

(51) Int. Cl.

*H01F 41/04* (2006.01)
*H01F 27/28* (2006.01)
*H01F 41/10* (2006.01)
*H01F 7/06* (2006.01)

(52) U.S. Cl.

CPC ..... *H01F 41/042* (2013.01); *H01F 7/06* (2013.01); *H01F 27/2804* (2013.01); *H01F 41/041* (2013.01); *H01F 41/10* (2013.01); *H01F 2007/068* (2013.01); *H01F 2027/2809* (2013.01)

(58) Field of Classification Search

USPC ..... 156/248, 249, 267, 305, 307.1, 307.3, 156/701, 703, 704

See application file for complete search history.

(56) References Cited

U.S. PATENT DOCUMENTS 4,901,178 A * 2/1990 Kobayashi ..... G11B 5/31 29/603.14
5,110,668 A * 5/1992 Minnick ..... B32B 7/12 428/215
5,208,066 A * 5/1993 Fujisaki ..... B82Y 10/00 257/E21.259

(Continued)

FOREIGN PATENT DOCUMENTS

KR 10-1618015 B1 5/2016

*Primary Examiner* — Sing P Chan

(74) *Attorney, Agent, or Firm* — Wolf, Greenfield & Sacks, P.C.

(57) ABSTRACT

Provided is a method of manufacturing a coil unit in a thin film type for a compact actuator, and more particularly, a method of manufacturing a coil unit in a thin film type for a compact actuator in which a buffer layer is formed on a coil layer to prevent cracks in the coil layer and a substrate.

According to the method of manufacturing the coil unit in a thin film type for a compact actuator of the present invention, the buffer layer is formed on the coil layer so that an impact to the coil layer during a back-grinding process for thinning a substrate is absorbed, thereby preventing the substrate and the coil layer from breaking due to the back-grinding process and compensating for a difference of deformation between the coil unit and the substrate according to a difference of coefficients of thermal expansion.

Further, according to the present invention, as the substrate is thinned by performing a back-grinding process, a gap which is a distance between a permanent magnet and the coil layer is reduced, and therefore sensitivity of the compact actuator can be improved.

7 Claims, 6 Drawing Sheets

(56) References Cited

U.S. PATENT DOCUMENTS 5,666,235 A * 9/1997 Izuka ..... G11B 7/0933 359/814
6,286,207 B1 * 9/2001 Oura ..... C23C 18/1608 205/126
6,367,143 B1 * 4/2002 Sugimura ..... H01F 17/0033 29/602.1
6,449,835 B1 * 9/2002 Oura ..... C23C 18/1608 174/266
6,523,256 B1 * 2/2003 Oura ..... C23C 18/1608 174/257
6,564,448 B1 * 5/2003 Oura ..... C23C 18/1608 29/830
7,973,722 B1 * 7/2011 Hill ..... H01Q 7/08 343/702
8,169,286 B2 * 5/2012 Hasegawa ..... H01F 27/2871 336/200
8,322,882 B2 * 12/2012 Ward ..... H01L 24/97 362/249.02
8,631,567 B2 * 1/2014 Lee ..... H05K 3/429 156/184
9,130,265 B1 * 9/2015 Hill ..... H01Q 7/08
9,338,899 B2 * 5/2016 Lee ..... H05K 3/429
9,647,327 B2 * 5/2017 Schindler ..... G06K 19/077
9,673,646 B1 * 6/2017 Cheng ..... H02J 50/10
9,680,205 B2 * 6/2017 Li ..... H01Q 1/243
9,743,529 B2 * 8/2017 Lee ..... H05K 3/06
9,812,256 B2 * 11/2017 Yang ..... H01F 38/14
9,817,096 B2 * 11/2017 Freytag ..... G01R 33/4215
9,833,312 B2 * 12/2017 Galstian ..... A61F 2/1627
9,855,081 B2 * 1/2018 Janna ..... A61B 17/72
9,930,818 B2 * 3/2018 Lee ..... H02J 5/005
2008/0014768 A1 * 1/2008 Lee ..... H05K 3/429 439/77
2008/0197960 A1 * 8/2008 Hasegawa ..... H01F 27/2871 336/110
2010/0162562 A1 * 7/2010 Lee ..... H05K 3/429 29/852
2014/0096383 A1 * 4/2014 Lee ..... H05K 3/429 29/852
2015/0279547 A1 * 10/2015 Park ..... H01F 27/2804 361/770
2017/0118833 A1 * 4/2017 Lee ..... H05K 1/028
2017/0178802 A1 * 6/2017 Yang ..... H02J 50/10
2017/0201114 A1 * 7/2017 Chang ..... H02J 7/025
2017/0317505 A1 * 11/2017 Lim ..... H01F 27/2804
2017/0317506 A1 * 11/2017 Lim ..... H01F 27/2804
2018/0019058 A1 * 1/2018 Kwon ..... H01F 41/042

* cited by examiner

METHOD OF MANUFACTURING COIL UNIT IN THIN FILM TYPE FOR COMPACT ACTUATOR

CROSS-REFERENCE TO RELATED APPLICATION

This application claims priority to Korean Patent Application No. 10-2016-0089007, filed on Jul. 14, 2016 in the Korean Intellectual Property Office, the disclosure of which is incorporated herein by reference in its entirety.

BACKGROUND

1. Field of the Invention

The present invention relates to a method of manufacturing a coil unit in a thin film type for a compact actuator, and more particularly, to a method of manufacturing a coil unit in a thin film type for a compact actuator in which a buffer layer is formed on a coil layer to prevent cracks in the coil layer and a substrate.

2. Discussion of Related Art

Camera modules with an autofocus (AF) function of automatically controlling focus of a lens when capturing a subject have been widely applied to mobile devices, such as cellular phones and tablet PCs, in addition to general digital cameras.

Recently innovations are not limited to the autofocus function, and the camera modules employing a hand-tremor correction method have also continuously emerged. Hand-tremor correction methods may be divided into an electronic method and an optical method in a broad sense. An electronic image stabilizer (EIS) uses a method of image processing an image signal output from an image sensor. An optical image stabilizer (OIS) uses a method of mechanically controlling a position or an angle of an image sensor or a lens optical system.

As a prior art, Korean Registered Patent No. 10-1618015, in "COIL COMPONENT FOR ELECTROMAGNETIC ACTUATOR AND MANUFACTURING METHOD THEREOF," a technique including a substrate, a buffer layer provided on a surface of the substrate, an insulating unit laminated on the buffer layer and including one or more insulating layers, and a coil unit provided inside the insulating unit and including one or more coil layers that are electrically connected to the outside to receive an external voltage and form an electromagnetic field for generating mechanical motions of a device, wherein the buffer layer absorbs a weight applied to the substrate from the insulating unit and the coil unit and is capable of compensating for a difference between deformation of the coil unit and deformation of the substrate according to a difference of coefficients of thermal expansion is disclosed. However, such systems for laminating a buffer layer between a substrate and a coil unit are known to use a seed layer lamination method which is generally used in a process of fabricating a semiconductor in a thin film type. Further, even after a back-grinding process is performed on the substrate, a final substrate has a thickness of 50 μm or more, and thus cracks in the coil unit and the substrate due to the thickness of the substrate still occur and a micro actuator is difficult to implement.

SUMMARY OF THE INVENTION

Therefore, the present invention is provided to address the problems described above and is directed to providing a method of manufacturing a coil unit in a thin film type for a compact actuator in which a buffer layer is formed on a coil layer and then a back-grinding process is performed on a substrate to have a small thickness.

Further, the present invention is directed to providing a method of manufacturing a coil unit in a thin film type for a compact actuator in which a gap, which is a distance between a permanent magnet and a coil layer, is reduced because a thickness of a substrate becomes small through a back-grinding process and a thickness of a buffer layer becomes large.

The present invention is directed to providing a method of manufacturing a coil unit in a thin film type for a compact actuator. The method may include a first step of laminating one or more coil layers on a substrate, a second step of forming a buffer layer on the coil layer, a third step of forming an adhesive layer on the buffer layer to fix the coil unit on the adhesive layer and performing a back-grinding process on a back surface of the substrate, and a fourth step of removing the adhesive layer and mounting the coil unit manufactured by cutting a portion of a side of the substrate on a surface of a flexible printed circuit board (FPCB).

One or more bump pads may be formed on a portion of an upper part of the coil layer to cause the coil layer to conduct between the first step and the second step, and the buffer layer may be applied on the upper part of the coil layer except a space in which the hump pads are formed using a filler.

The coil layer may be a patterned coil, and the filler may be applied and cured in the same pattern as the coil.

A height of the filler be equal to or less than a height of the bump pads.

The substrate may have a thickness of 1 μm to 40 μm using a back-grinding process or may be removed.

According to an aspect of the present invention, there is provided a method of manufacturing a coil unit in a thin film type for a compact actuator including: a first step of laminating one or more coil layers on a substrate, a second step of forming a buffer layer on the one or more coil layers, a third step of forming an adhesive layer on the buffer layer to fix the coil unit on the adhesive layer and back-grinding a back surface of the substrate, and a fourth step of removing the adhesive layer and mounting the coil unit manufactured by cutting a portion of a side of the substrate on a surface of an FPCB.

A material of a coil included in the coil layer in the first step may be a metal conductor formed of copper as a main component, the metal conductor may have a height in a range of 10 μm to 80 μm and a line width in a range of 5 μm to 50 μm, the metal conductor may be formed to be spaced apart by an insulating layer, and the insulating layer may have a thickness in a range of 1 μm to 10 μm.

When a plurality of coil layers are laminated in the first step, an insulating layer may be formed between a lower coil layer and an upper coil layer, and the insulating layer may have a thickness in a range of 1 μm to 30 μm.

One or more bump pads may be formed on a portion of an upper part of the coil layer to cause the coil layer to conduct between the first step and the second step, and the buffer layer may be applied on the upper part of the coil layer except a space where the bump pads are formed using a filler.

The coil layer may be a patterned coil, and the filler may be applied and cured in the same pattern as the coil.

A height of the filler may be equal to or less than a height of the bump pads.

The substrate may have a thickness of 1 μm to 40 μm using a back-grinding process or may be removed.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Terms and words used in this specification and claims should not be interpreted as limited to commonly used meanings or meanings in dictionaries but should be interpreted with meanings and concepts which are consistent with the technological scope of the invention based on the principle that the inventors have appropriately defined concepts of terms in order to describe the invention in the best way.

Therefore, since the embodiments described in this specification and configurations illustrated in drawings are only exemplary embodiments and do not represent the overall technological scope of the invention, it is understood that the invention covers various equivalents, modifications, and substitutions at the time of filing of this application.

Figure 1:
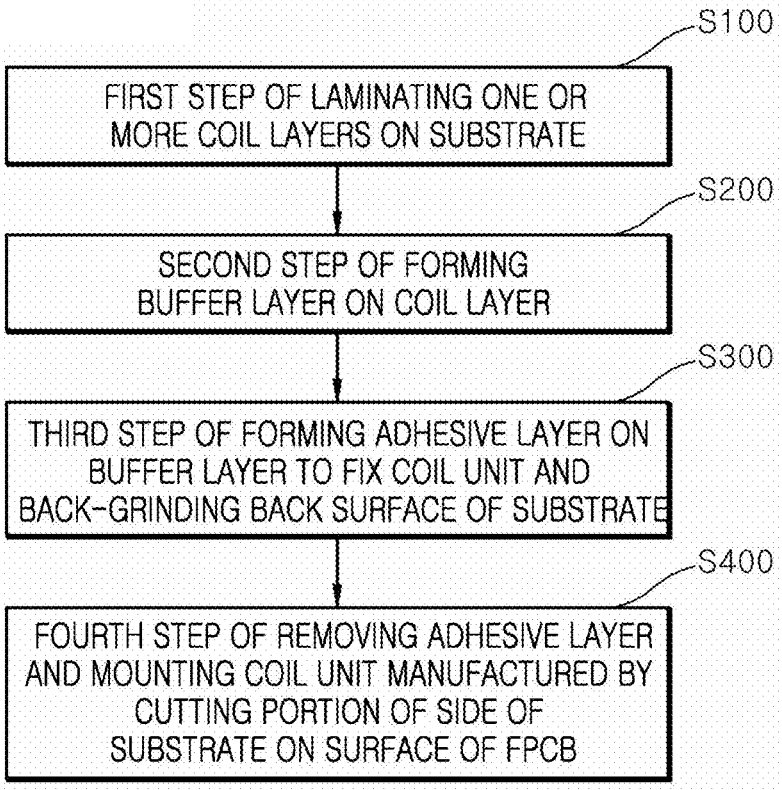
FIG. 1 is a flowchart by step according to an embodiment of the present invention.

FIG. 1 is a flowchart by step according to an embodiment of the present invention. Referring to FIG. 1, a coil unit in a thin film type for a compact actuator according to the embodiment of the present invention is manufactured by a first step of laminating one or more coil layers on a substrate (S100), a second step of forming a buffer layer on the coil layer (S200), a third step of forming an adhesive layer on the buffer layer to fix the coil unit on the adhesive layer and back-grinding a back surface of the substrate (S300), and a fourth step of removing the adhesive layer and mounting the coil unit manufactured by cutting a portion of a side of the substrate on a surface of a flexible printed circuit board (FPCB) (S400).

Here, in the third step (S300), the coil layer and the buffer layer may be laminated in a parallel structure when one or more coil layers and the buffer layer are laminated on the substrate for mass production of the coil unit.

Figure 2:
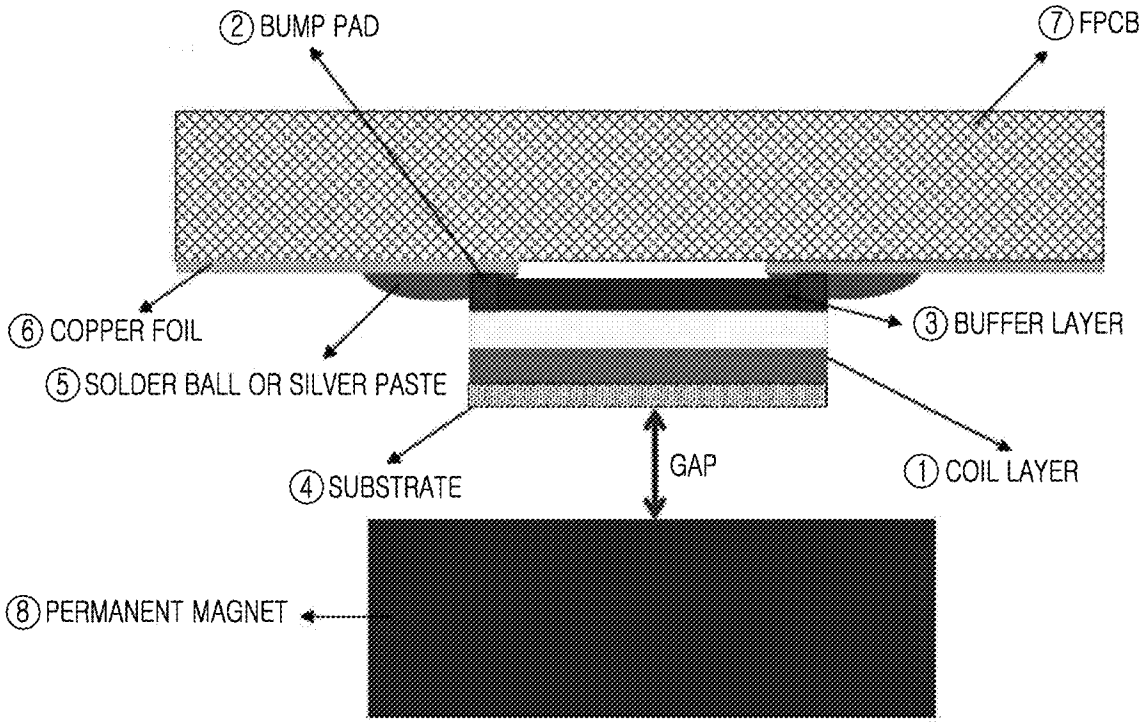
FIG. 2 is a cross-sectional view illustrating a state in which a coil unit in a thin film type manufactured by a manufacturing method according to an embodiment of the present invention is mounted on a compact actuator.

FIG. 2 is a cross-sectional view illustrating a state in which a coil unit in a thin film type manufactured by the manufacturing method according to the embodiment of the present invention is mounted on a compact actuator. Referring to FIG. 2, a gap is formed between a permanent magnet and a substrate, wherein the permanent magnet is disposed under the gap and the substrate is disposed above the gap, one or more coil layers are provided on the substrate, a bump pad and a buffer layer are formed on the coil layers, and solder or a silver paste is applied on the buffer layer or the bump pad in order that the coil unit adheres to and electrically communicates with the FPCB. Here, a thickness of the substrate may be in a range of 1 μm to 40 μm. When the thickness of the substrate is greater than 40 μm, there are disadvantages in that an electromagnetic field effect occurring between the coil layer and the permanent magnet may be reduced, and a micro coil unit may not be readily implemented. Further, a back grinding process may be performed on the substrate such that a coil surface is exposed according to process characteristics. A thickness of the buffer layer may be in a range of 50 μm to 100 μm. When the thickness of the buffer layer is less than 50 μm, there are disadvantages in that damage and cracks on the substrate and the coil layer may not be readily prevented, and when the thickness of the buffer layer is greater than 100 μm, a micro coil unit may not be readily implemented. Further, the gap between the coil unit and the permanent magnet may be reduced to within about 200 μm using the substrate on which the back-grinding process is performed. A magnetic field effect according to a gap and a permanent magnet may be defined as in the following Expression.

$$B \propto \frac{1}{L^2} \ (B = \text{magnetic flux density}, L = \text{distance}) \qquad \text{(Expression 1)}$$

On the other hand, a space between the buffer layer and a copper foil may or may not be formed. A height of a filler may be equal to or less than a height of the bump pad.

Figure 3:
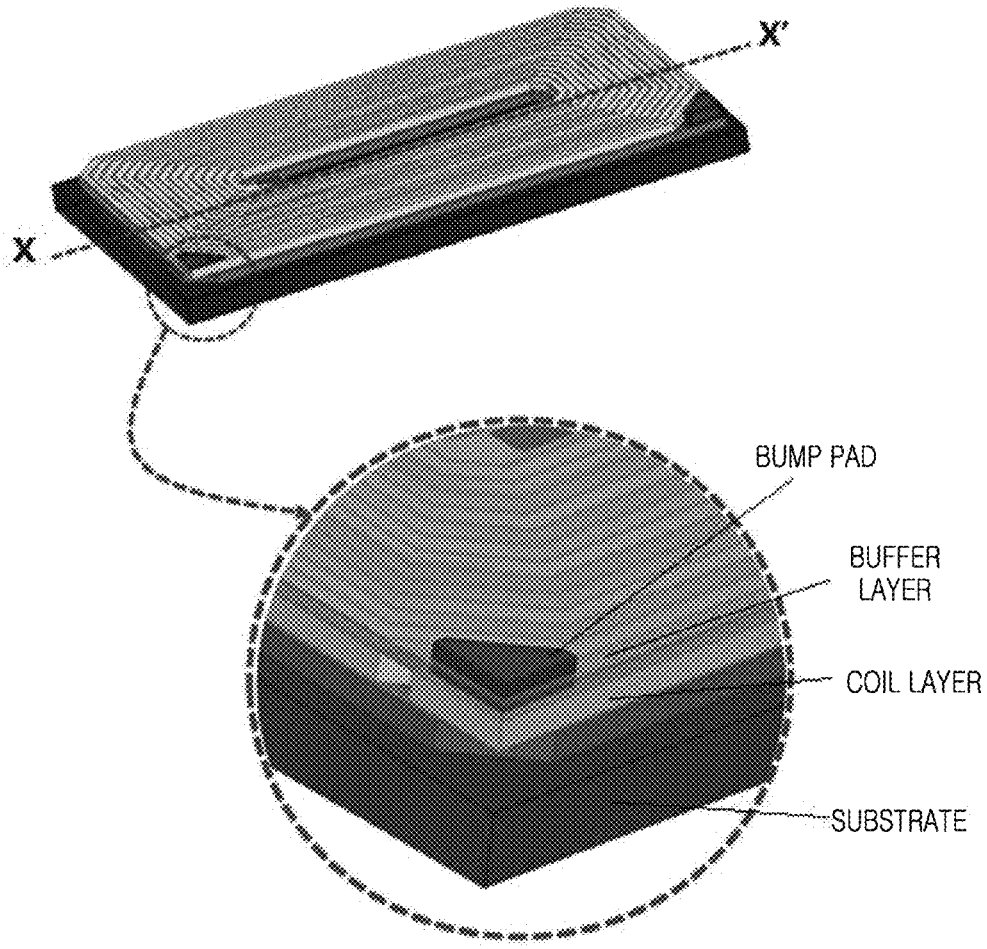
FIG. 3 is a perspective view of the coil unit in a thin film type manufactured by the manufacturing method according to the embodiment of the present invention.

FIG. 3 is a perspective view of the coil unit in a thin film type manufactured by the manufacturing method of the embodiment of the present invention. Referring to an enlarged portion of the coil unit of FIG. 3, the substrate, the coil layer, the bump pad and the buffer layer formed on the coil layer may be formed from the bottom of the coil unit. Therefore, even when an external impact is applied to the coil unit, the buffer layer has a shock-absorbing effect, which can prevent the coil layer and the substrate from being damaged and cracking.

Figure 4:
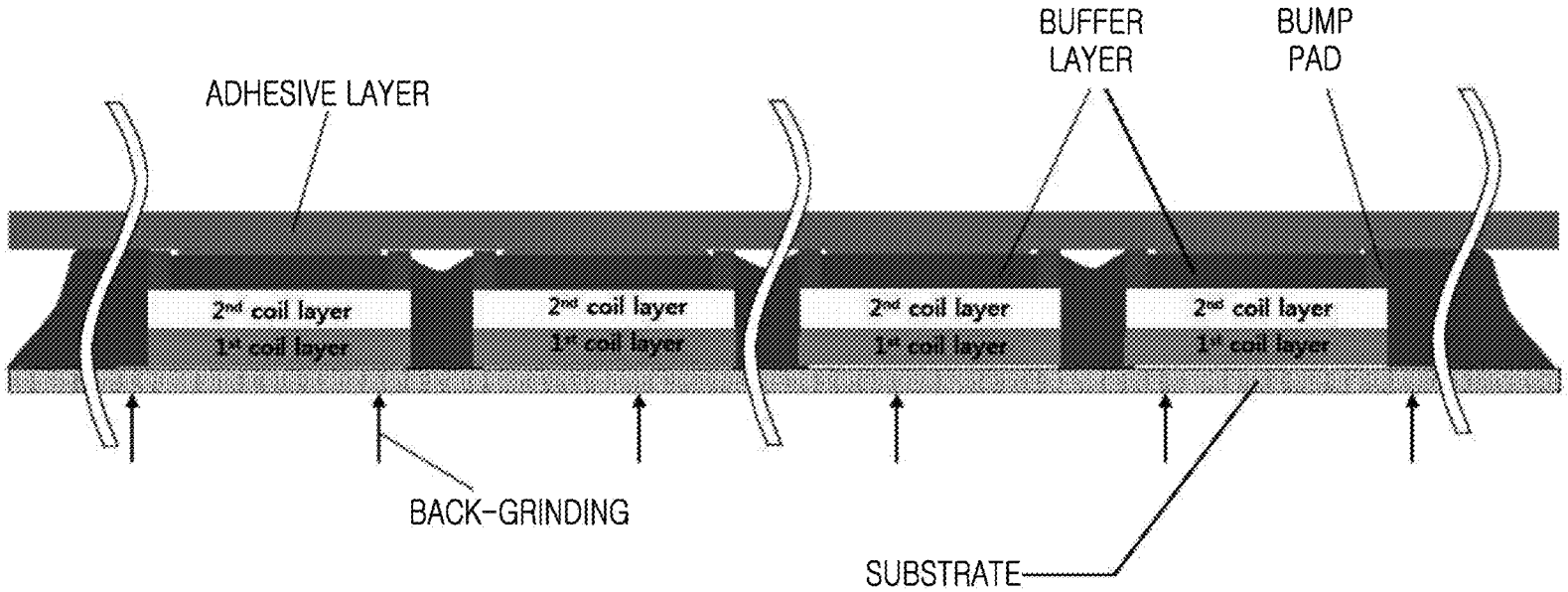
FIG. 4 is a diagram illustrating a back-grinding process performed on a substrate according to an embodiment of the present invention.

FIG. 4 is a diagram illustrating a back-grinding process performed on a substrate according to an embodiment of the present invention. Referring to FIG. 4, one or more coil layers may be laminated on the substrate, and the buffer layer may be formed on an uppermost coil layer. Here, before the buffer layer is formed, one or more bump pads may be formed under a portion of the coil layer to cause the coil layer to conduct between the first step and the second step of FIG. 1. The buffer layer may be applied on a part of the coil layer other than a space at which the bump pads are formed using a filler. Alternatively, when the coil unit is mass-produced, the buffer layer may be applied in a gap between the coil units. The filler may be a resin. The coil layer may have a via hole to electrically communicate with another coil layer or the bump pads. Then, an adhesive layer may be formed on the buffer layer or the bump pads. The adhesive layer may be formed to fix the coil unit in order for performing a back-grinding process on the substrate. When the adhesive layer is formed to fix the coil unit, a back-grinding process is performed a back surface of the substrate. Then, the single coil unit may be mass produced by cutting a side of the substrate of each coil unit, and the coil unit is mounted on an FPCB using an automatized SMT apparatus after removing the adhesive layer.

Figure 5:
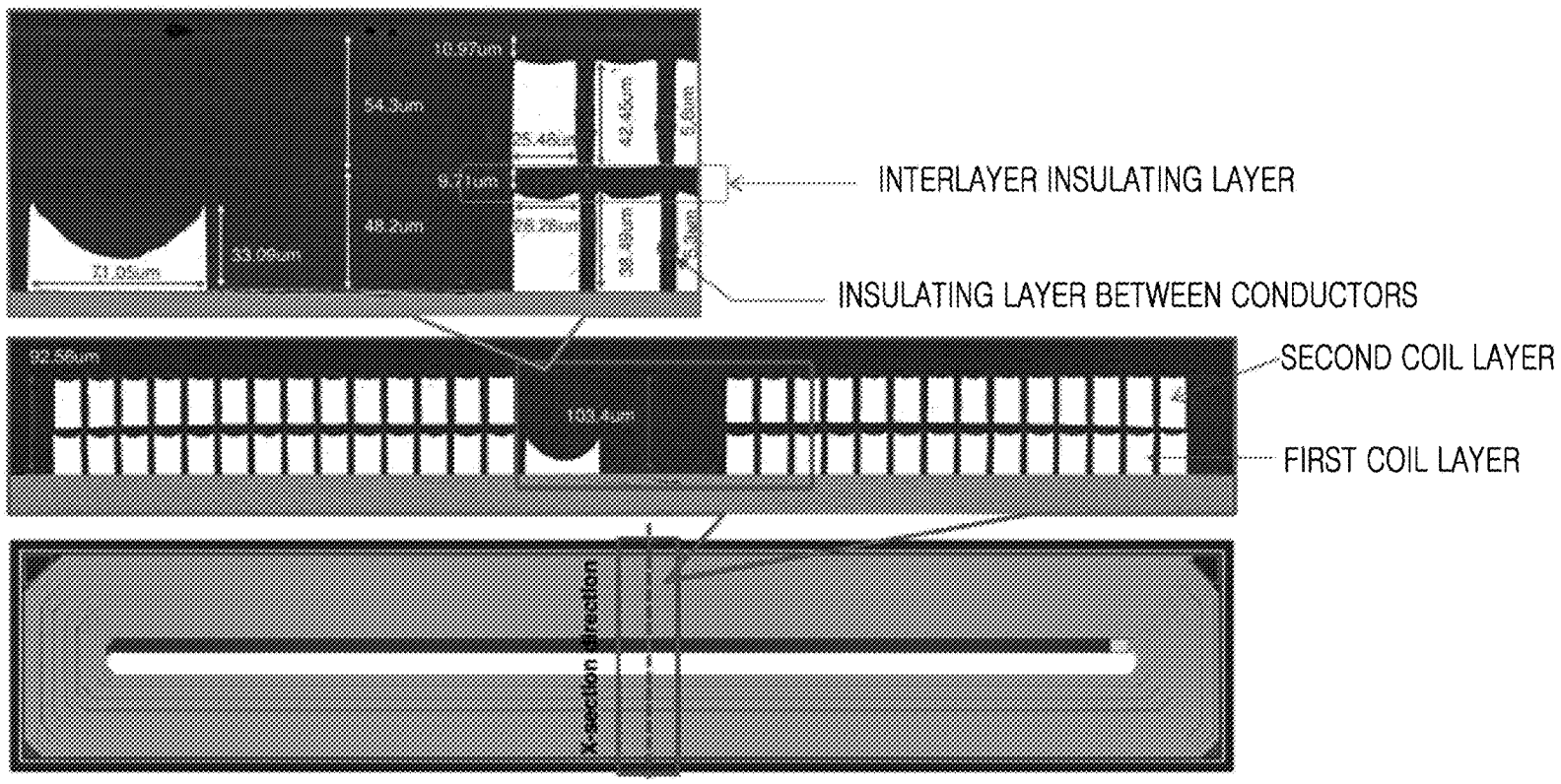
FIG. 5 is a cross-sectional view of the coil unit in a thin film type manufactured by the manufacturing method according to the embodiment of the present invention.

FIG. 5 is a cross-sectional view of the coil unit in a thin film type manufactured by the manufacturing method according to the embodiment of the present invention.

Figure 6:
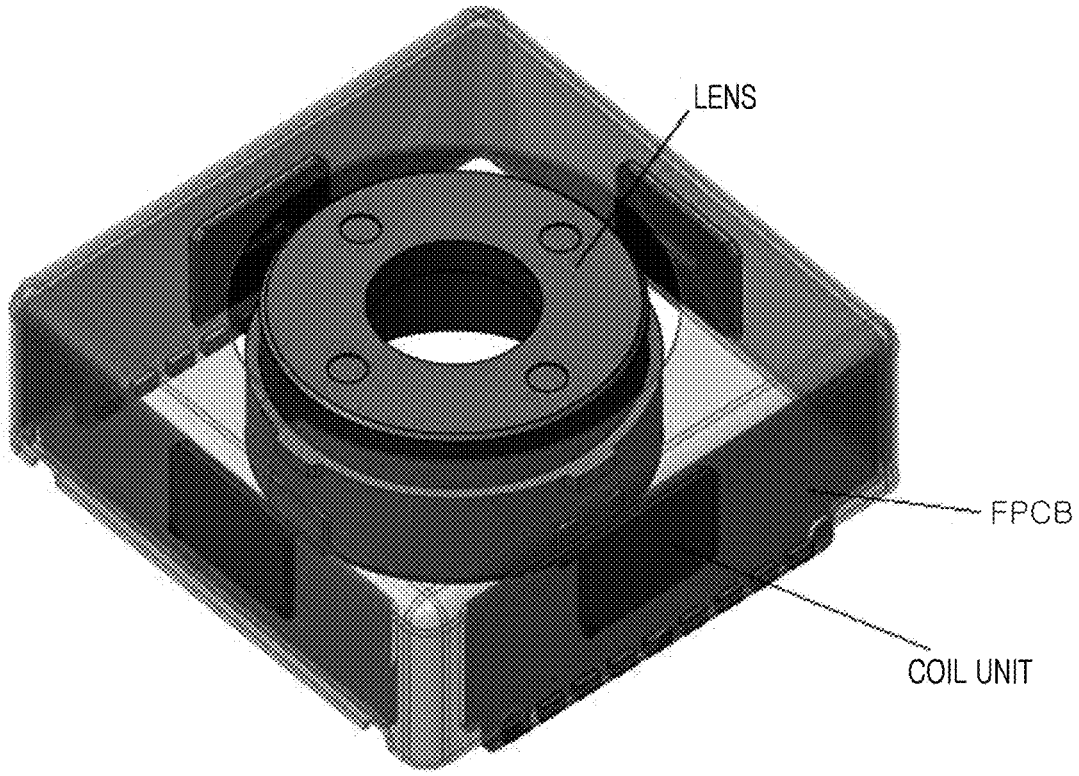
FIG. 6 is a perspective view illustrating a state in which the coil unit in a thin film type manufactured by the manufacturing method according to the embodiment of the present invention is mounted on the compact actuator.

FIG. 6 is a perspective view illustrating a state in which the coil unit in a thin film type manufactured by the manufacturing method according to the embodiment of the present invention is mounted on the compact actuator. Referring to FIG. 6, it is understood that a copper foil and the coil unit on the FPCB are within a close distance from each other. For example, "compact actuator" may be a general term for a device unit having a function of correcting autofocus or hand tremor of a digital camera module which is applied to a smartphone.

According to the method of manufacturing a coil unit in a thin film type for a compact actuator of the present invention, a buffer layer filled with a resin is formed on a coil layer so that an impact to the coil layer during a back-grinding process for thinning a substrate is absorbed, thereby preventing the substrate and the coil layer from breaking due to the back-grinding process and compensating for a difference of deformation between the coil unit and the substrate according to a difference of coefficients of thermal expansion.

Further, according to the present invention, as the substrate can be thinned by performing a back-grinding process, a gap which is a distance between a permanent magnet and a coil layer is reduced, and therefore performance improvement including sensitivity improvement of the compact actuator on which the coil unit of the present invention is mounted and yield improvement can be achieved.

Further, according to the present invention, in manufacturing a compact actuator, a coil unit in a thin film type can be manufactured using an automatized SMT apparatus, thereby simplifying a process and reducing production cost.

While the present invention has been described with reference to exemplary embodiments, it will be understood by those skilled in the art that various changes and modifications may be made without departing from the spirit and scope of the present invention as defined by the appended claims.

What is claimed is:

1. A method of manufacturing a coil unit in a thin film type for a compact actuator, comprising:

a first step of laminating one or more coil layers on a substrate;

a second step of forming a buffer layer on the one or more coil layers;

a third step of forming an adhesive layer on the buffer layer to fix the coil unit on the adhesive layer and back-grinding a back surface of the substrate; and a fourth step of removing the adhesive layer and mounting the coil unit manufactured by cutting a portion of a side of the substrate on a surface of a flexible printed circuit board ("FPCB").

2. The method of claim 1, wherein:

a material of the coil included in the coil layer in the first step includes a metal conductor formed of copper as a main component;

the metal conductor has a height in a range of 10 μm to 80 μm;

the metal conductor has a line width in a range of 5 μm to 50 μm;

the metal conductor is formed to be spaced apart by an insulating layer; and the insulating layer has a thickness in a range of 1 μm to 10 μm.

3. The method of claim 1, wherein, when a plurality of coil layers are laminated in the first step, an insulating layer is formed between a lower coil layer and an upper coil layer and the insulating layer has a thickness in a range of 1 μm to 30 μm.

4. The method of claim 1, wherein:

one or more bump pads are formed on a portion of an upper part of the coil layer to cause the coil layer to conduct between the first step and the second step; and the buffer layer is applied on the upper part of the coil layer except a space at which the bump pads are formed using a filler.

5. The method of claim 4, wherein the coil layer is a patterned coil, and the filler is applied and cured in the same pattern as the coil.

6. The method of claim 4, wherein a height of the filler is equal to or less than a height of the bump pads.

7. The method of claim 1, wherein the substrate is back-ground to a thickness of 1 μm to 40 μm.

* * * * *